US005863028A

United States Patent [19]

Dunsmore

[11] Patent Number: 5,863,028

[45] Date of Patent: Jan. 26, 1999

[54] POWERED DRIVER

[76] Inventor: Richard F. Dunsmore, 2605 Grist Mill Rd., Marietta, Ga. 30068

[21] Appl. No.: 814,114

[22] Filed: Mar. 10, 1997

[51] Int. Cl.[6] ..... B66D 1/00

[52] U.S. Cl. ..... 254/343; 254/362; 242/323

[58] Field of Search ..... 242/323, 250, 242/225; 254/342, 343, 362, 395

[56] References Cited

U.S. PATENT DOCUMENTS

| | | | |
|---|---|---|---|
| 3,126,166 | 3/1964 | Weinberg | 242/250 |
| 3,929,555 | 12/1975 | Sanders | 254/362 |
| 4,290,584 | 9/1981 | Eckels et al. | 242/390.8 |
| 4,331,323 | 5/1982 | Sekimori et al. | 254/362 |
| 4,598,878 | 7/1986 | Steffan | 242/323 |
| 4,962,901 | 10/1990 | Shirley et al. | 242/323 |
| 5,048,799 | 9/1991 | Aronowitsch et al. | 242/323 |
| 5,386,970 | 2/1995 | Trant . | |
| 5,394,815 | 3/1995 | Hansen | 242/323 |

*Primary Examiner*—Katherine Matecki
*Attorney, Agent, or Firm*—Eric R. Katz

[57] ABSTRACT

A powered winch driver is disclosed for operating a winch having a rotatable, typically ratcheted capstan including a socket for receiving a star stub. The driver comprises: a water proof housing having an upper plate including a socket for receiving a manual winch handle and a lower body having an opening therethrough; a battery powered motor connected by an on/off switch to a rechargeable battery contained by the water proof housing; a rotatable shaft mounted for rotation relative to the water proof housing and having a star stub extending through the opening in the lower body of the water proof housing; a water tight seal for sealing the opening in the lower body through which the rotatable shaft extends; and a drive unit connecting the battery powered motor to the rotatable shaft for rotatably driving the shaft when the motor is operated and for locking the shaft against rotation when the motor is stationary.

20 Claims, 2 Drawing Sheets

POWERED DRIVER

BACKGROUND OF THE INVENTION

1. Field of the Invention

The present invention generally relates to a powered driver for driving a rotatable item, and more particularly, to a self-locking, cordless, rechargeable, powered winch driver adapted for use with existing winches and manual winch handles.

2. Background Discussion

It is well known for marine craft, such as sailboats, to utilize a number of lines that are hauled in or let out to raise and lower various types of sails as well to control the shape of such sails. In order to reduce the level of effort required to control these lines, both manual or power winches have been employed to ease the effort of pulling in lines under tension.

It is common to use winch handles to drive manual winches which typically comprise a capstan mounted for rotation about an axis of rotation, the capstan being provided with a socket for removably securing the winch handle to manually rotate the capstan. Power winches usually employ a motor, generally mounted below decks, for rotating the capstan.

It is relatively common to use releasable winch handles on marine craft, particularly when different winches at various locations on the vessel require operation over a short period of time, for example, during a tacking maneuver. In this regard, it is also well known to provide such winch handles with a locking mechanism which locks the handle to the winch during use and releases the handle for removal. Also known are manual winch handles which float.

U.S. Pat. No. 5,386,970 discloses a power handle for operating a winch. Although operationally efficient, the power handle of the '970 patent requires an external power source, is relatively large, bulky and unwieldy, cannot float and requires the use of a fixed handle such that if the drive motor is not operated, the power handle cannot be manually operated to turn a winch.

Moreover, the power handle of the '970 patent makes no provision for releasably locking the handle to the winch during use and therefore, is prone to uncontrollable release during high torque driving of the winch. Further, a standard, manual winch handle cannot be used by the power handle of the '970 patent.

SUMMARY OF THE INVENTION

Accordingly, it is an object of the present invention to provide a powered winch driver which overcomes the deficiencies of the prior art.

It is a further object of the present invention to provide a powered winch driver which is self-locking, cordless, rechargeable, unsinkable and adapted for use with existing winches and winch handles.

An other object of the present invention is to provide a powered winch driver which includes an arrangement for releasable locking the driver to the winch during use.

One advantageous feature of the present invention is that the power winch driver employs a self locking drive, such as a worm drive, to permit manual operation of the winch driver using a standard, manual winch handle which is adapted to be releasably attached to the power winch driver.

These and other objects, advantages and features of the present invention are achieved, according to one embodiment of the present invention, by a powered winch driver for operating a winch having a rotatable, typically ratcheted, capstan including a socket for receiving a star stub, the driver comprising: a water proof housing having an upper plate including a socket for receiving a star stub of a manual winch handle and a lower body having an opening therethrough; a battery powered motor connected to a rechargeable battery contained by the water proof housing; a rotatable shaft mounted for rotation relative to the water proof housing and having a star stub extending through the opening in the lower body of the water proof housing; a water tight seal for sealing the opening in the lower body through which the rotatable shaft extends; and a drive unit connecting the battery powered motor to the rotatable shaft for rotatably driving the shaft when the motor is operated and for locking the shaft against rotation when the motor is stationary.

DETAILED DESCRIPTION OF THE PREFERRED EMBODIMENT(S)

Figure 1:
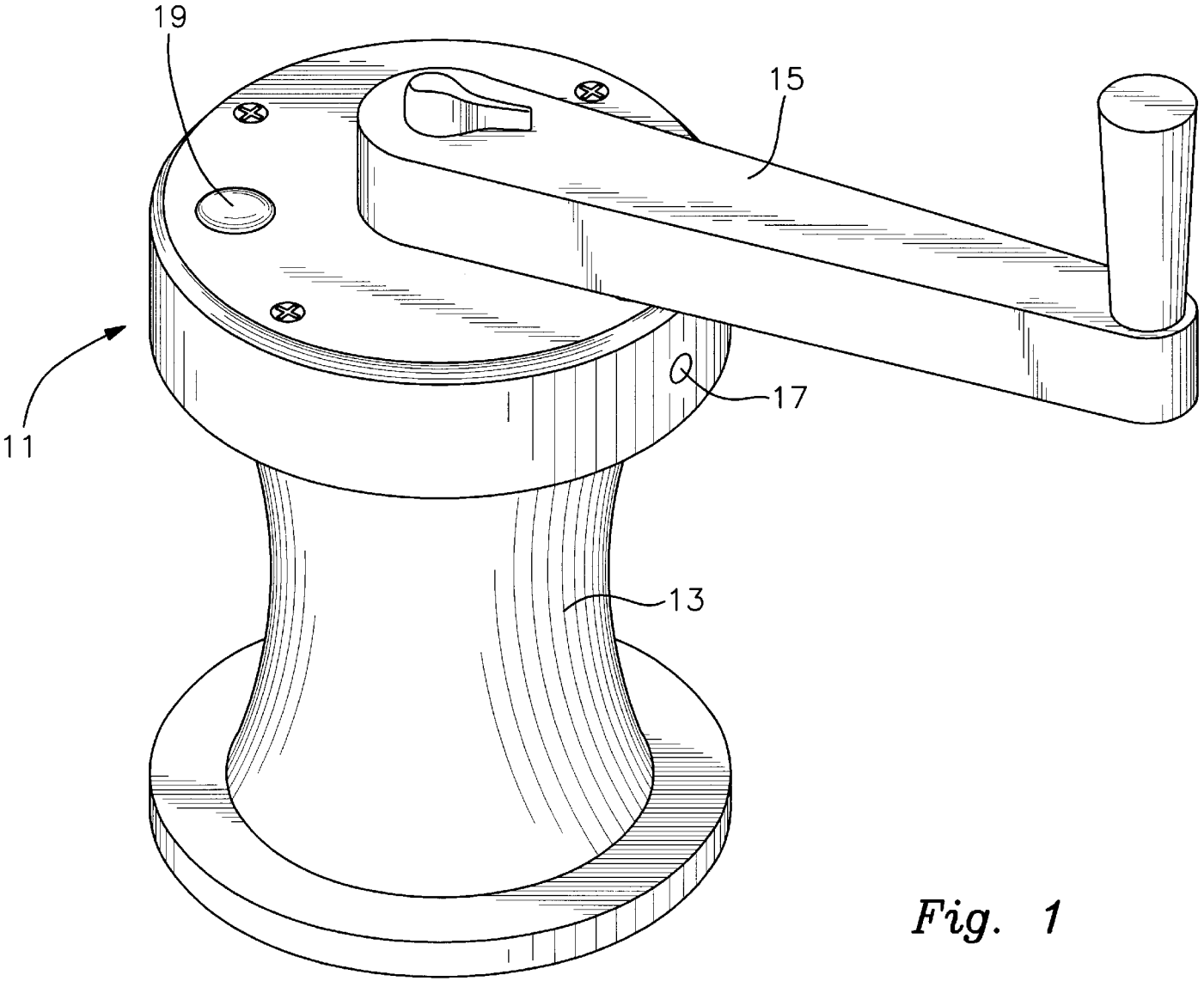
FIG. 1 is a perspective view of one embodiment of the driver of the present invention applied onto a winch and having a manual winch handle attached thereto.

Referring to FIG. 1, one embodiment of a power winch driver, generally indicated at 11, is illustrated attached to a winch 13 having a rotatable capstan including a socket (not shown) for receiving a star stub. In FIG. 1, a manual winch handle 15, preferably a floating winch handle, is shown removable attached to the power driver 11 as will be more fully described hereinafter.

The power winch driver 11 is battery powered, for example, by a nickel-cadmium battery power source and therefore is provided with an electrical socket 17 for receiving a plug (not shown) of a battery recharging unit. Also shown in FIG. 1 is an on/off switch 19 for turning the power driver 11 on and off.

Figure 2:
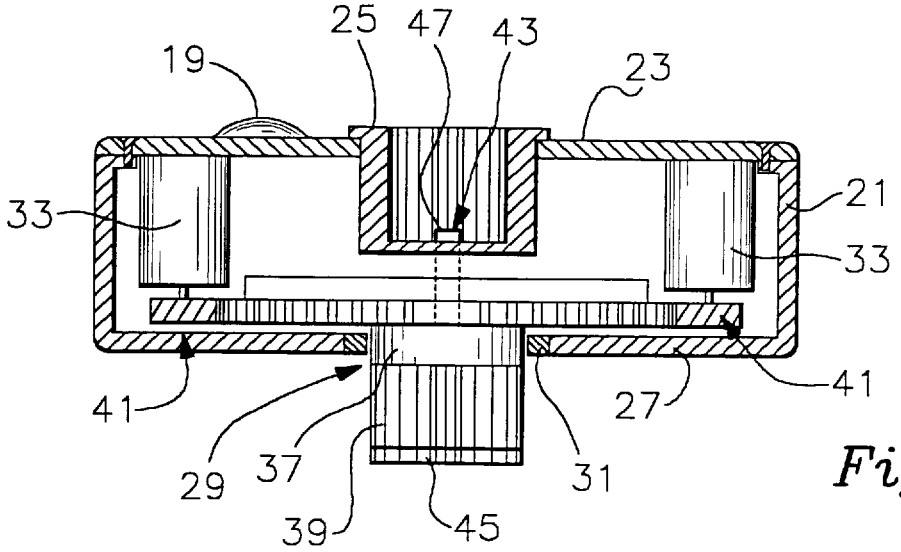
FIG. 2 is a side section view of the driver of FIG. 1.

Referring to FIG. 2, the power winch driver 11 comprises a water proof housing 21 having an upper plate 23 which is attached to the housing 21 by fasteners, for example screws or the like, so that the upper plate 23 can be removed in order to service the various internal components of the power driver 11. A seal (not shown) may be required at the upper plate 23 in order assure that the housing is water proof.

The upper plate 23 includes a socket 25 for receiving, for example, a star stub (not shown) of the manual winch handle 15. However, it is understood by those skilled in the art that the socket 25 of the upper plate 23 can be adapted to receive any manual tool which operates by rotation, such as for example, screw drivers, socket wrenches cranks and the like.

The housing 21 is also provided with a lower body 27 having an opening, generally indicated at 29, therethrough. The housing is made of a high impact strength, light weight material, for example, a polycarbonate material, so that the power winch driver 11 will have structural integrity as well as have positive buoyancy such that the driver 11, when dropped into water, will float.

Figure 3:
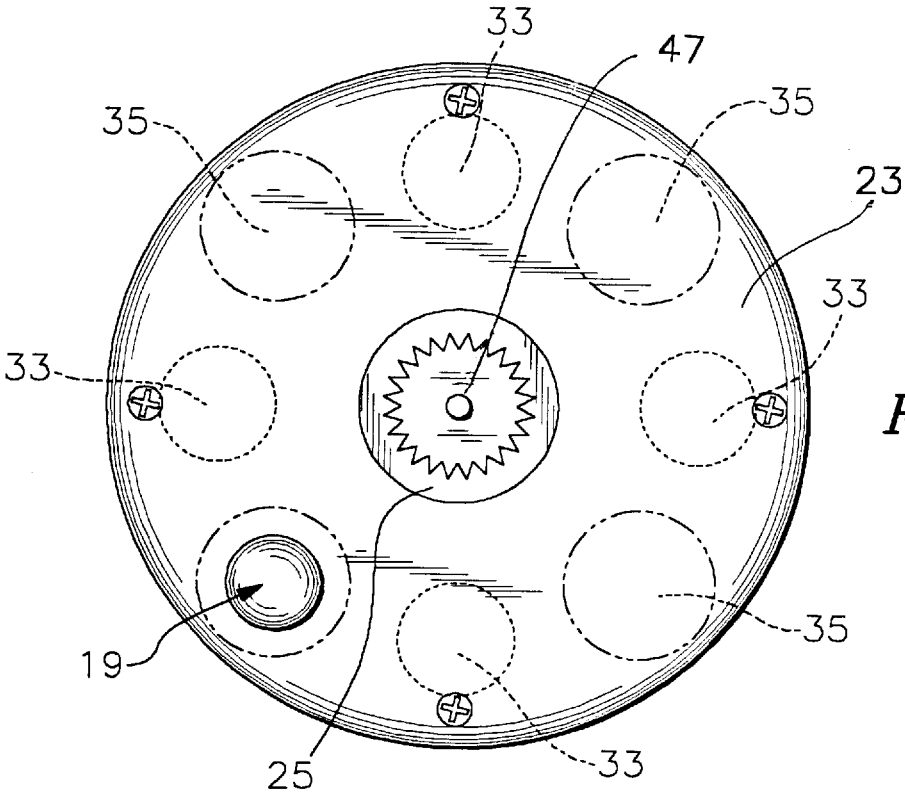
FIG. 3 is a top, planar view of the driver of FIG. 1.

Contained by the water proof interior of the housing 21 is at least one battery powered electric motor 33 connected to a rechargeable battery 35 as best seen in FIG. 3. In the embodiment illustrated, the power driver 11 is provided with four separate electric motors 33, which are powered by a plurality of interconnected nickel cadmium rechargeable batteries 35 which function collectively as a power source, in order to assure that sufficient torque and power is provided to operate the power driver 11.

A rotatable shaft 37 is mounted for rotation relative to the water proof housing 21 and is provided with an end 39, for example having a star stub for insertion into the socket of the winch 13, extending through the opening 29 in the lower body 27 of the water proof housing. A water tight seal 31 seals the opening 29 in the lower body 27 through which the rotatable shaft 37 extends.

A drive unit, generally indicated at 41, connects the battery powered motors 33 to the rotatable shaft 37 for rotatably driving the shaft 37 when the motors 33 are operated and for locking the shaft 37 against rotation when the motors 33 are stationary. In this regard, a worm gear mechanism is sufficient to function as the drive unit 41.

The power driver 11 also includes a locking mechanism, generally indicated at 43 for locking the star stub 39 of the shaft 37 to the socket of the winch 13. Such locking mechanisms are known and comprise a spring loaded, radially movable, locking plate 45 at the end of the star stub 39 of the rotatable shaft 37. The plate 45 is aligned with the star stub 39 in the unlocked position to allow for insertion and withdrawal of the star stub 39 relative to the socket of the winch 13. However, in the locked position, the plate 45 is rotated relative to the star stub 39 in order to lock the power driver 11 to the winch 13.

In the embodiment illustrated by FIG. 2, the locking mechanism 43 is moved to a locking position by depressing a pin 47 at a bottom of the socket 25 in the upper plate 23 for receiving the star stub of the manual winch handle 15 and is moved to a release position when the pin 47 is released. Therefore, the manual winch handle 15, when inserted into the socket 25, will depress the pin 47 and lock the power winch driver 11 to the winch 13. Removal of the handle 15 will release the pin 47 and unlock the driver 11 from the winch 13.

In operation, the end 39 of the shaft 37 of the power winch driver 11 is inserted into the socket (not shown) of the winch 13. The housing 21 of the driver 11 is manually held and the on/off switch 19 activated to provide power to the motors 33 so as to rotate shaft 37 and drive the winch 13. Alternatively, the manual winch handle 15 is inserted into the socket 25 in the upper plate 23 after the shaft 37 of the driver 11 is inserted into the socket (not shown) of the winch 13.

The handle 15 will depress pin 47 of the locking mechanism 43 thereby rotating plate 45 at the end 39 of the shaft 37 to lock the driver to the winch 13. The switch 19 is then depressed and the operator holds the handle 15 thereby holding the housing 21 of the driver 11 stationary relative to the winch 13 while the shaft 37 rotates the winch 13. It should be noted that the operator can also rotate the entire power driver 11 by cranking the handle 15 while the shaft 37 is being driven by the electric motors 33 to thereby increase the amount of torque provided at the shaft 37.

The power driver 11 can also be operated completely manually. With the electric motors 33 off, the shaft 37 is locked against rotation by the worm drive mechanism. The driver 11 is inserted on to the winch 13 with the handle 15 affixed thereto as shown in FIG. 1 and the entire driver 11 rotated by cranking the handle 15.

Although the present invention has been described with particular reference to its preferred embodiments, it should be understood that many variations and modifications will now be obvious to those skilled in that art, and it is preferred, therefore, that the scope of the invention be limited, not by the specific disclosure herein, but only by the appended claims. For example, instead of driving a winch, the power driver 11 can be adapted for use with any item requiring rotation by adapting the end of the shaft 37 for attachment to the item to be rotated. In addition, socket 25 can be adapted to receive almost any hand held tool, including, but not limited to, screw drivers, socket wrenches, cranks and the like.

What is claimed is:

1. A powered winch driver for operating a winch having a rotatable capstan including a socket for receiving a star stub, the driver comprising:

a water proof housing having an upper plate including a socket for receiving a manual winch handle and a lower body having an opening therethrough;

a battery powered motor connected by an on/off switch to a rechargeable battery contained by the water proof housing;

a rotatable shaft mounted for rotation relative to the water proof housing and having a star stub extending through the opening in the lower body of the water proof housing;

a water tight seal for sealing the opening in the lower body through which the rotatable shaft extends; and a drive unit connecting the battery powered motor to the rotatable shaft for rotatably driving the shaft when the motor is operated and for locking the shaft against rotation when the motor is stationary.

2. A winch driver according to claim 1, wherein the drive unit is a worm gear mechanism.

3. A winch driver according to claim 1, wherein the rechargeable battery is a nickel cadmium battery.

4. A winch driver according to claim 1, wherein the motor is a plurality of motors positioned radially about an axis of rotation of the shaft.

5. A winch driver according to claim 4, wherein the rechargeable battery comprises a plurality of interconnected nickel cadmium batteries.

6. A winch driver according to claim 1, further comprising a locking mechanism for locking the star stub of the shaft to the socket of the winch.

7. A winch driver according to claim 6, wherein the locking mechanism is moved to a locking position by depressing a pin at a bottom of the socket in the upper plate for receiving the star stub of a manual winch handle and is moved to a release position when the pin is released.

8. A winch driver according to claim 7, wherein the locking mechanism includes a spring loaded, radially movable, locking plate at an end of the star stub of the rotatable shaft.

9. A winch driver according to claim 1, further comprising a manual winch handle inserted to the socket of the upper plate of the water proof housing.

10. A winch driver according to claim 1, further including an electrical port in the water proof housing for connecting the rechargeable battery to a recharging power source.

11. A powered driver for rotating an item having a rotatable body including a socket for receiving a shaft, the driver comprising:

a housing having an upper plate including a socket for receiving a manual handle and a lower body having an opening therethrough;

a battery powered motor connected by an on/off switch to a rechargeable battery;

a rotatable shaft mounted for rotation relative to the housing and having an end extending through the opening in the lower body of the housing; and a drive unit connecting the battery powered motor to the rotatable shaft for rotatably driving the shaft when the motor is operated and for locking the shaft against rotation when the motor is stationary.

12. A driver according to claim 11, wherein the drive unit is a worm gear mechanism.

13. A driver according to claim 11, wherein the rechargeable battery is a nickel cadmium battery.

14. A driver according to claim 11, wherein the motor is a plurality of motors positioned radially about an axis of rotation of the shaft.

15. A driver according to claim 14, wherein the rechargeable battery is a plurality of interconnected nickel cadmium batteries.

16. A driver according to claim 11, further comprising a locking mechanism for locking the end of the shaft to the socket of the item to be rotated.

17. A driver according to claim 16, wherein the locking mechanism is moved to a locking position by depressing a pin at a bottom of the socket in the upper plate for receiving the end of a manually operated handle and is moved to a release position when the pin is released.

18. A driver according to claim 17, wherein the locking mechanism includes a spring loaded, radially movable, locking plate at the end the rotatable shaft.

19. A driver according to claim 11, further comprising a manually operated handle inserted to the socket of the upper plate of the housing.

20. A driver according to claim 11, further including an electrical port in the housing for connecting the rechargeable battery to a recharging power source.

* * * * *